United States Patent [19]

Chen et al.

[11] Patent Number: 4,737,263

[45] Date of Patent: Apr. 12, 1988

[54] PROCESS AND APPARATUS FOR CATALYTIC DEWAXING OF PARAFFINIC STOCKS AND THE SIMULTANEOUS REMOVAL OF CRACKED PRODUCTS

[75] Inventors: Nai Y. Chen, Tittusville, N.J.; Thomas F. Degnan, Jr., Yardley, Pa.; Bruce P. Pelrine, Lawrenceville; Richard F. Socha, Trenton, both of N.J.

[73] Assignee: Mobil Oil Corporation, New York, N.Y.

[21] Appl. No.: 884,466

[22] Filed: Jul. 11, 1986

Related U.S. Application Data

[63] Continuation-in-part of Ser. No. 743,721, Jun. 11, 1985, abandoned, which is a continuation-in-part of Ser. No. 662,873, Oct. 19, 1984, abandoned.

[51] Int. Cl.[4] ..... C10G 23/00

[52] U.S. Cl. ..... 208/120; 208/146; 208/111; 422/220; 422/209; 422/205

[58] Field of Search ..... 208/111, 120, 127, 157, 208/213, 144, 146, 147, 176; 422/209, 270, 271, 213, 205, 220, 238

[56] References Cited

U.S. PATENT DOCUMENTS

| | | | |
|---|---|---|---|
| Re. 28,300 | 1/1975 | Butler et al. | 208/120 |
| Re. 28,398 | 4/1975 | Chen et al. | 208/111 |
| 2,231,424 | 2/1941 | Huppke | 422/220 X |
| 2,493,917 | 1/1950 | Hengstebeck | 422/209 X |
| 2,520,424 | 8/1950 | Mills et al. | 422/205 X |
| 2,704,741 | 3/1955 | Thayer | 208/147 X |
| 2,706,167 | 4/1955 | Harper et al. | 208/213 |
| 2,746,950 | 5/1956 | Lolli | 422/270 |
| 2,987,465 | 6/1961 | Johanson | 208/213 |
| 3,140,322 | 7/1964 | Frilette et al. | 260/667 |
| 3,297,505 | 1/1967 | Garwood et al. | 208/120 |
| 3,453,083 | 7/1969 | Beerli | 422/270 |
| 3,489,675 | 1/1970 | Scott | 208/120 |
| 3,761,393 | 9/1973 | Wolk et al. | 208/146 X |
| 3,969,274 | 7/1976 | Frampton | 502/242 |
| 4,158,622 | 6/1979 | Schwarzenbek | 208/213 |
| 4,222,855 | 9/1980 | Pelrine et al. | 208/111 |
| 4,263,126 | 4/1981 | Rollmann | 208/14 |
| 4,317,746 | 3/1982 | Richardson | 502/211 |
| 4,332,670 | 6/1982 | Antal | 208/85 |
| 4,410,416 | 10/1983 | Everman | 422/271 |

OTHER PUBLICATIONS

Chemical Reaction Engineering, Levenspiel, 1972, John Wiley & Sons.

*Primary Examiner*—Helen M. S. Sneed
*Assistant Examiner*—Glenn Caldarola
*Attorney, Agent, or Firm*—Alexander J. McKillop; Michael G. Gilman; Dennis P. Santini

[57] ABSTRACT

Dewaxing a waxy feedstock is achieved by submerging the dewaxing catalyst bed in the waxy feedstock and removing gaseous products out of contact with the catalyst by agitating the bed to prevent further cracking or polymerization. Catalyst aging during dewaxing is significantly reduced by operating the dewaxing reactor within a narrow low temperature range.

30 Claims, 9 Drawing Sheets

SCHEMATIC OF IMMERSED CATALYST REACTOR SYSTEM

SCHEMATIC OF IMMERSED CATALYST REACTOR SYSTEM

PROCESS AND APPARATUS FOR CATALYTIC DEWAXING OF PARAFFINIC STOCKS AND THE SIMULTANEOUS REMOVAL OF CRACKED PRODUCTS

CROSS-REFERENCE TO RELATED APPLICATIONS

This application is a continuation-in-part of co-pending application Ser. No. 743,721, filed June 11, 1985, now abandoned, which is a continuation-in-part of co-pending application Ser. No. 662,873, filed Oct. 19, 1984, now abandoned, both of which are incorporated herein by reference.

BACKGROUND OF THE INVENTION

1. Field of the Invention

This invention relates to a novel process and reactor for catalytically dewaxing a waxy liquid petroleum feedstock utilizing a shape-selective crystalline zeolite catalyst. More particularly, this invention relates to improvements in the shape-selective dewaxing of liquid petroleum feedstocks to obtain improved product quality, operating efficiency, as well as improvements in the aging characteristics of the shape-selective dewaxing catalyst.

2. Discussion of the Prior Art

The cracking and/or hydrocracking of petroleum stocks is in general well known and widely practiced. It is known to use various zeolites to catalyze cracking and/or hydrocracking processes. The cracking may have the intent to convert a certain class of compounds in order to modify a characteristic of the whole petroleum stock. Exemplary of this type of conversion is shape-selective conversion of straight and slightly branched aliphatic compounds of 12 or more carbon atoms to reduce pour point, pumpability, and/or viscosity of heavy fractions which contain these waxy constituents. The long carbon chain compounds tend to crystallize on cooling of the oil to an extent such that the oil will not flow, hence may not be able to be pumped or transported by pipelines. The temperature at which such mixture will not flow is designated the "pour point", as determined by standarized test procedures.

The pour point problem can be overcome by techniques known in the art for removal of waxes or conversion of those compounds to other hydrocarbons which do not crystallize at ambient temperatures. An important method for so converting waxy hydrocarbons is shape-selective cracking or hydrocracking utilizing principals described in U.S. Pat. No. 3,140,322 dated July 7, 1964. Zeolitic catalysts for selective conversions of wax described in the literature include such species as mordenite, with or without added metal, to function as a hydrogenation catalyst.

Particularly effective catalysts for catalytic dewaxing include zeolite ZSM-5 and related porous crystalline aluminosilicates, as described in U.S. Re. Pat. No. 28,398 (Chen et al) dated Apr. 22, 1975. As described in that patent, drastic reductions in pour point are achieved by catalytic shape-selective conversion of the wax content of heavy stocks with hydrogen in the presence of a dual-functional catalyst of a metal plus the hydrogen form of ZSM-5. The conversion of waxes is by scission of carbon-to-carbon bonds (cracking) and production of products of lower boiling point than the wax. However, only minor conversion occurs in dewaxing. For example, Chen et al describe hydrodewaxing of a full range shale oil having a pour point of +80° F. (+27° C.) to yield a pumpable product of pour point at −15° F. (−26° C.). The shift of materials from the fraction heavier than light fuel oil to lighter component was in the neighborhood of 9% conversion.

Current technology for dewaxing petroleum stocks having elevated pour points involves the use of trickle beds, whereby gas (primarily hydrogen) and the petroleum stock concurrently flow downward over a bed of solid catalyst. This three-phase trickle bed concept makes use of an intimate mixing between gas and liquid phases while in contact with the catalyst in order to facilitate dewaxing. Performance level of the process is gauged by the length of time during which the process is producing products which meet specifications, as well as the minimum temperature required to attain acceptable products. A trickle bed process is disclosed in U.S. Pat. No. 4,332,670 to Antal, which is directed to hydrodewaxing a distillate hydrocarbon compound over a zeolite ZSM-5 containing catalyst. In the trickle bed reactor the gas is the continuous phase, while the liquid petroleum stock trickles down as a discontinuous phase.

In the hydroprocessing of liquid petroleum feedstocks, including heavy feedstocks, e.g., 650° F.+ (343° C.+) lube oils, it is desired to remove lighter conversion products from the liquid petroleum flow while concurrently providing a hydrogenative environment for catalytic conversion, which is particularly utilized in the case of the processing of highly waxy feedstocks. Frequently, lighter products which are obtained from cracking and/or hydrocracking reactions compete with the heavier feed molecules for access to the cracking sites in the zeolites which are employed in the implementation of the catalytic dewaxing process. Inasmuch as these lighter products diffuse more rapidly into the catalyst than the larger feed molecules, they have a tendency to retard the rate of conversion of the heavier molecules. Moreover, the lighter products also tend to be either more difficult to crack, such as low molecular weight paraffins, or easier to polymerize, such as low molecular weight olefins. They also possess a tendency to coke more readily than their heavier counterparts so as to thereby retard the conversion of the heavier molecules to an even greater extent.

This competition between the light and heavy liquid petroleum molecules is rendered particularly critical when there is employed a catalyst which essentially constitutes a shape-selective zeolite, for example, a zeolite exemplified by ZSM-5, for the dewaxing of liquid petroleum or lube stocks. Processes in reactors which utilize aluminosilicate zeolite catalysts, such as ZSM-5 or other zeolites having smaller pore openings, are disclosed in U.S. Pat. No. 4,222,855 to Pelrine et al and in U.S. Re. Pat. No. 28,398 to N. Y. Chen, both of which are incorporated herein by reference. U.S. Pat. No. 4,263,126 to Rollmann discloses dewaxing a hydrocarbon oil by use of a powdered ZSM-5 catalyst dispersed in the oil undergoing conversion.

Other techniques for catalytic hydrodewaxing involve the use of ebullated catalyst beds. U.S. Pat. No. 2,987,465 is directed to a batch process for contacting a liquid and a gas in the presence of an ebullating catalyst bed. The catalysts are maintained in random motion by up-flowing streams of liquid and gas which enter the bottom of the reactor. U.S. Pat. No. 2,706,167 to Harper is directed to the hydrogenation of hydrocarbon oils, in which the feedstock and hydrogen are introduced into the lower part of the reactor with force enough to suspend and ebullate the catalyst during the reaction. U.S. Pat. No. 4,317,746 to Richardson is directed to the use of rotating mixers to maintain catalyst particles in a state of suspension in an ebullating bed.

Although the utilization of different types of hydroprocessing reactors to implement catalytic dewaxing processes is disclosed in the prior art, as exemplified by the above-mentioned U.S. patents, broadly referring to ebullated reactors, stirring tank-type reactors or trickle bed reactors, there is an obvious need in the technology to more precisely define specific hydroprocessing reactor designs. Needed are reactors which, in a highly efficient and novel manner, will facilitate the removal of the lighter products from the liquid petroleum feedstocks through the intermediary of hydrogen stripping, while concurrently preserving an intimate three-phase contacting relationship among hydrogen, liquid petroleum feedstock and catalyst.

Another problem which has not been adequately solved during dewaxing of lubricating oil feedstocks with shape-selective zeolite catalysts is the aging of the dewaxing catalyst. Thus, it has been found that as dewaxing proceeds, a higher reactor temperature is required to compensate for decreased catalytic activity and meet product specifications. However, increasing the reactor temperature incurs additional energy costs, often changes the product distribution which is obtained, and often results in increased coking of the feedstock during dewaxing. Coking further decreases the catalyst life.

Accordingly, another object of the present invention is to reduce the aging rate of the shape-selective dewaxing catalyst during catalytic dewaxing of a lubricating oil or other waxy liquid petroleum feedstock.

SUMMARY OF THE INVENTION

The present invention is directed to producing a lubricating oil using a continuous stirred tank reactor (CSTR), in which the shape-selective dewaxing catalyst is immersed in the liquid to be dewaxed. In the preferred reactor types, the catalyst is submerged and rotated as a catalyst bed within the hydrocarbon liquid to be converted. Normally, lubricating oils are produced utilizing a fixed bed reactor. The current technology also utilizes a trickle bed reactor to remove lighter conversion products and provide a hydrogen environment. The object of the present invention is to provide a reactor which will remove the lighter products and preserve a three-phase relationship among hydrogen, the feedstock and the catalyst. Another object is to retard catalyst aging. We have found that by contacting a lubricating oil to be dewaxed with a hydrodewaxing catalyst and removing the resulting cracked gaseous products from the catalyst as soon as possible, the aforementioned objects could be attained.

The feedstock is contacted in a catalyst bed which is agitated. Hydrogen or another hydrocarbon-free gas is injected into the bed. By the agitation of the catalyst bed, the gases generated during the dewaxing operation are removed. It is important that the catalyst bed be completely submerged in the petroleum liquid being dewaxed, and that there be a minimum contact time between the catalyst and the product gases during the dewaxing step. Preferred conditions include a temperature of 500° to 1100° F. (260°-593° C.), preferably less than 700° F., and more preferably 540° to 565° F. (282°-296° C.); LHSV of 0.1 to 100; hydrogen-hydrocarbon mole ratio of 0 to 20; and pressure of 100 to 3000 psig.

In this invention, an improved dewaxing process and reactor are disclosed. Briefly stated, one aspect involves a process for hydrodewaxing lube oils comprising the steps of (a) contacting the lube oil to be dewaxed with a suitable hydrodewaxing catalyst, while (b) maintaining the dewaxing catalyst submerged in the liquid phase of said oil being dewaxed and removing the resulting cracked gaseous products from contact with the dewaxing catalyst as quickly as possible. One method of removing the gaseous products is to keep the interfacial area between the liquid and gas phases as large as possible to allow rapid devolution of the cracked products into a free gas phase above the liquid oil phase. Preferably, hydrogen is bubbled through the liquid to enhance removal of the cracked products.

In another aspect of the present invention, catalyst aging of the shape-selective dewaxing catalysts used to dewax lubricating oil petroleum feedstocks is substantially reduced by operating the dewaxing reactor within a narrow relatively low temperature range. A temperature range has been found which is high enough so as to effect a substantial reduction in the pour point of the product, but not so high as to cause catalyst deactivation. It has been found that dewaxing at a temperature in the range of 540° F. (282° C.) to less than 565° F. (296° C.) allows the feedstock to be dewaxed to a desired product pour point for a substantial period of time without the need to increase reactor temperature.

$$T_{corrected} = T_{actual} + (pour\ point - 20°\ F.);$$

Figure 4:
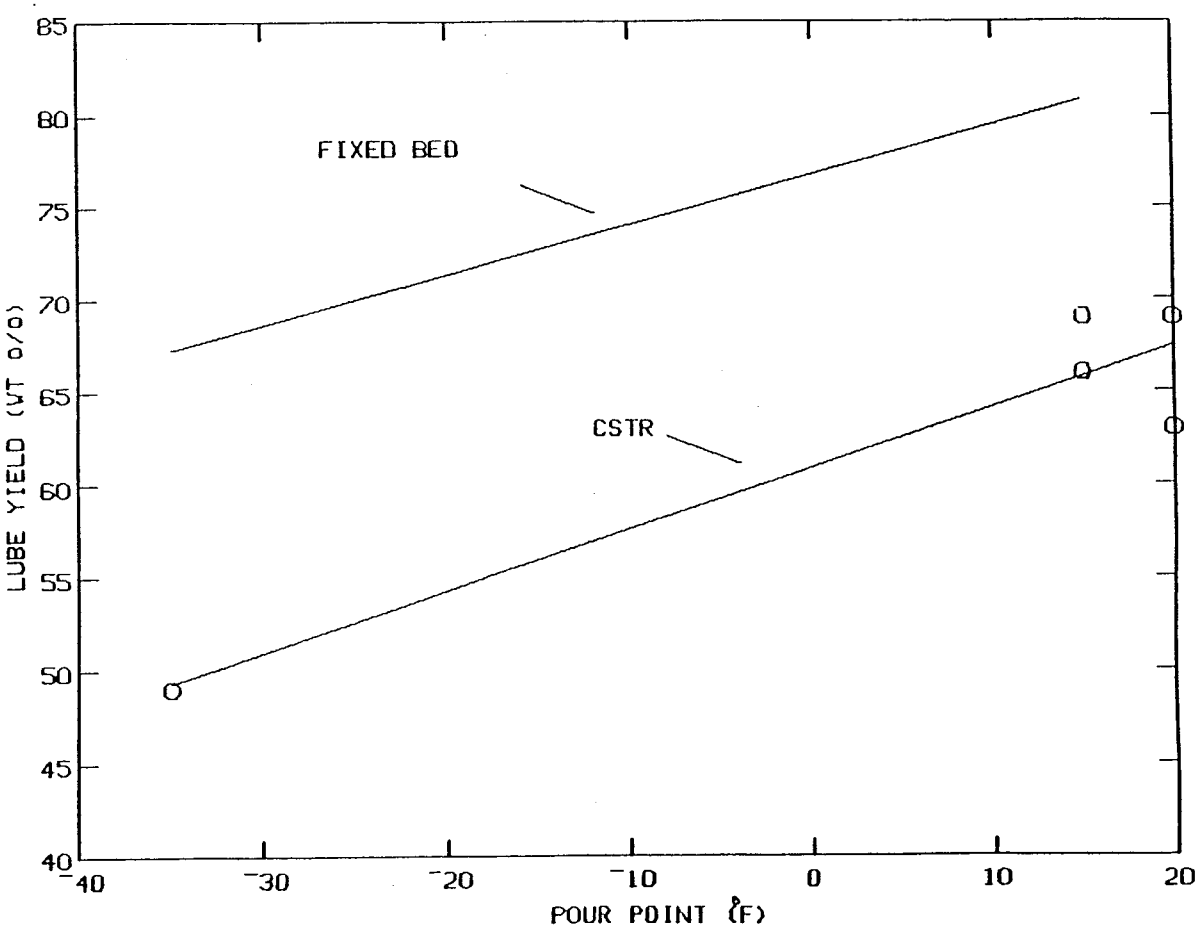
Figure 5:
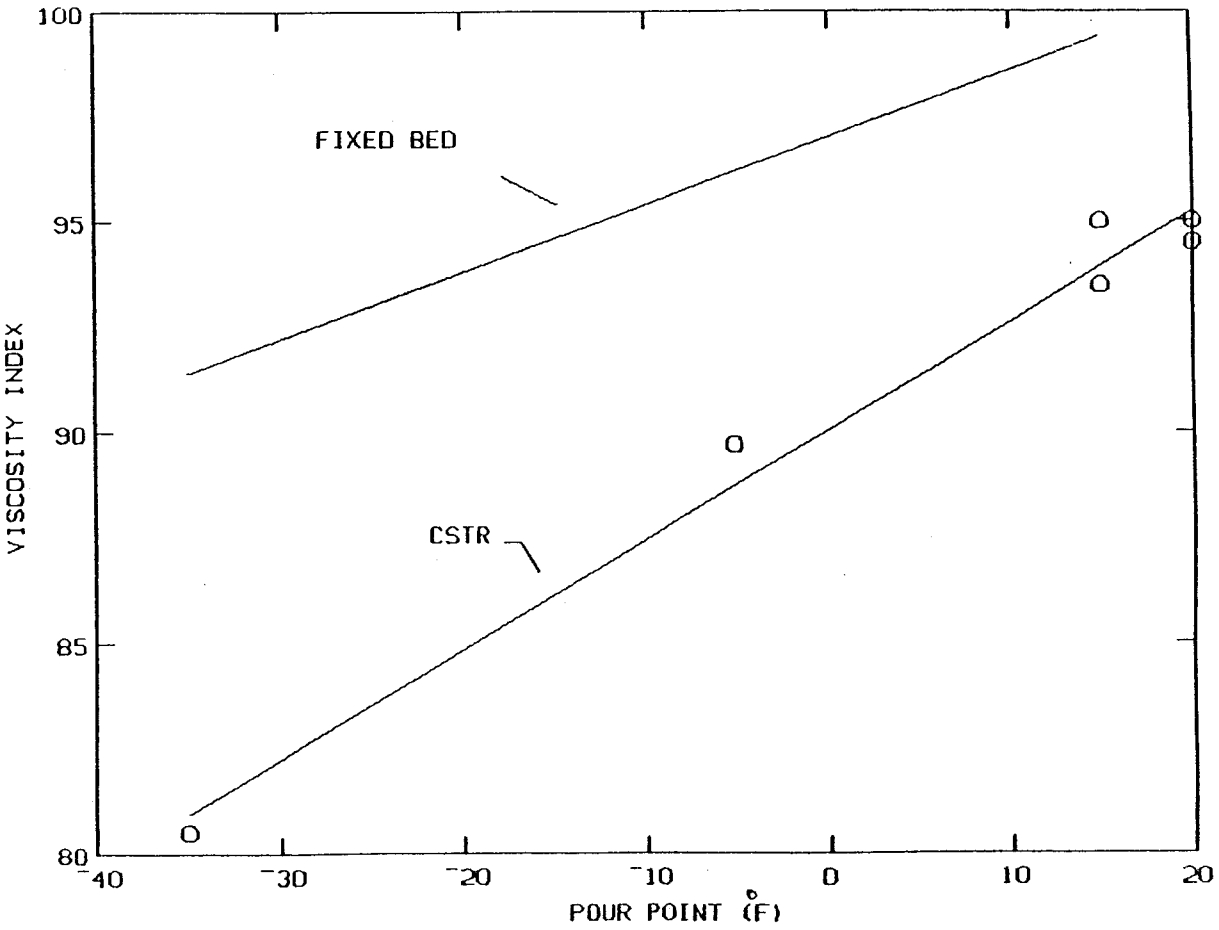
Figure 6:
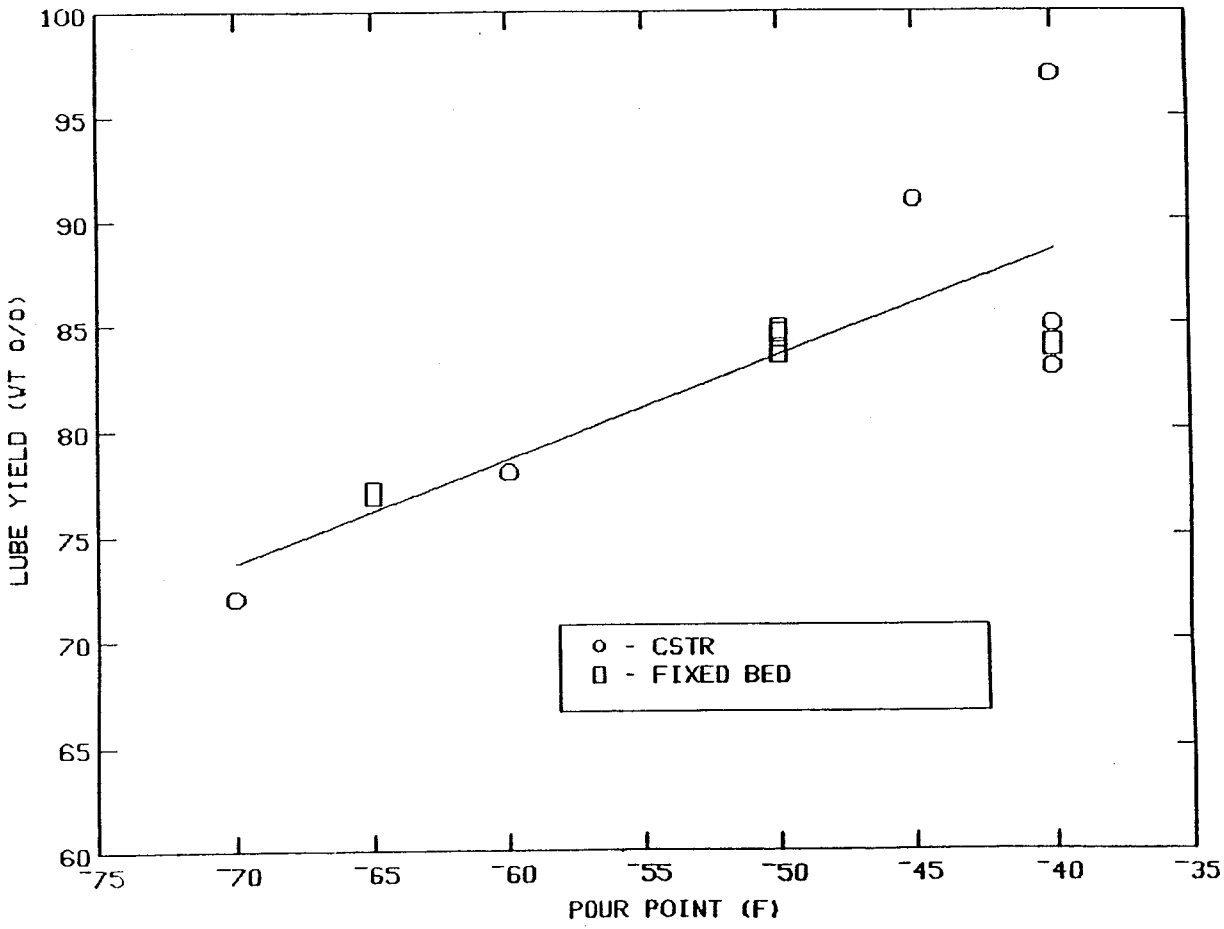
Figure 7:
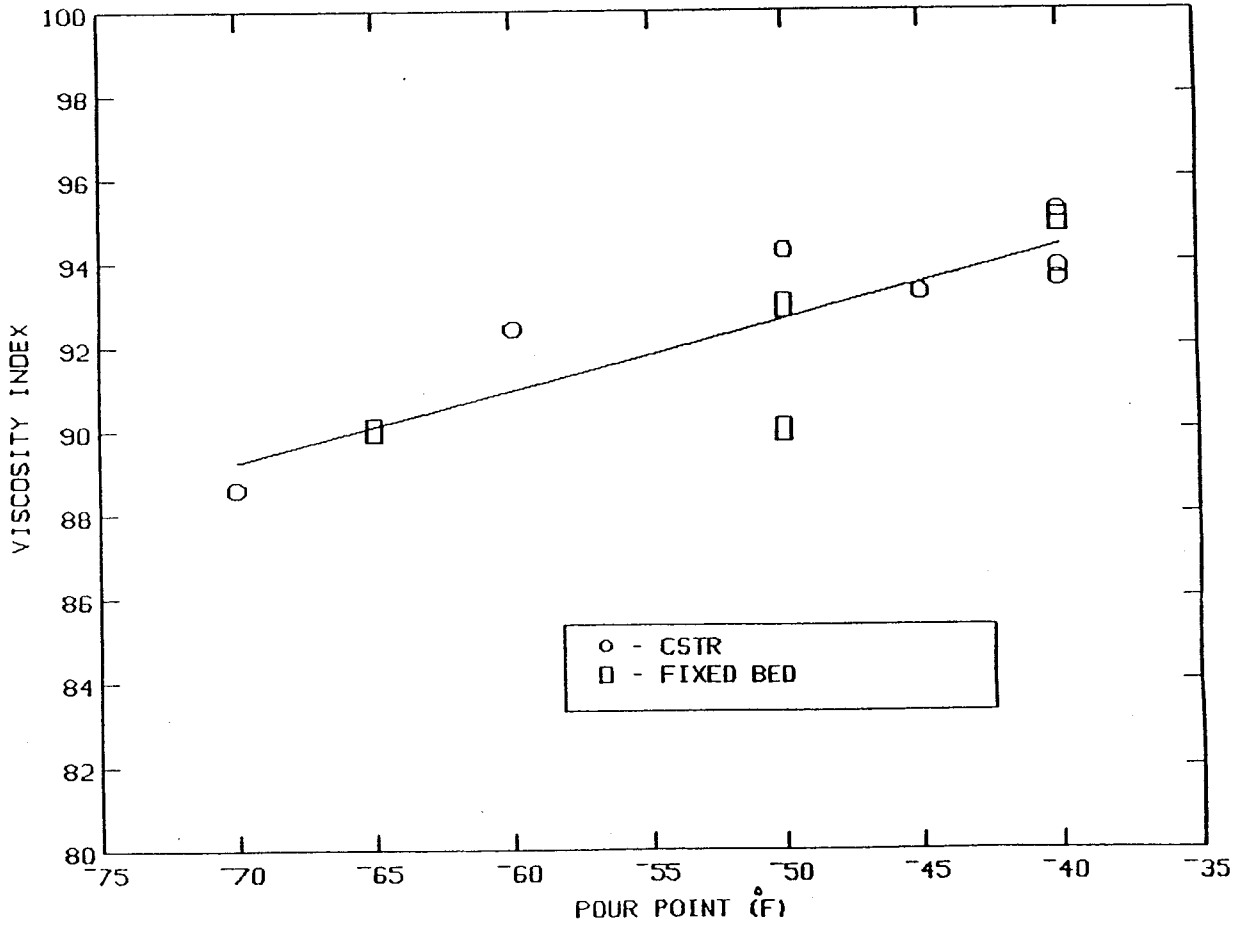
Figure 8:
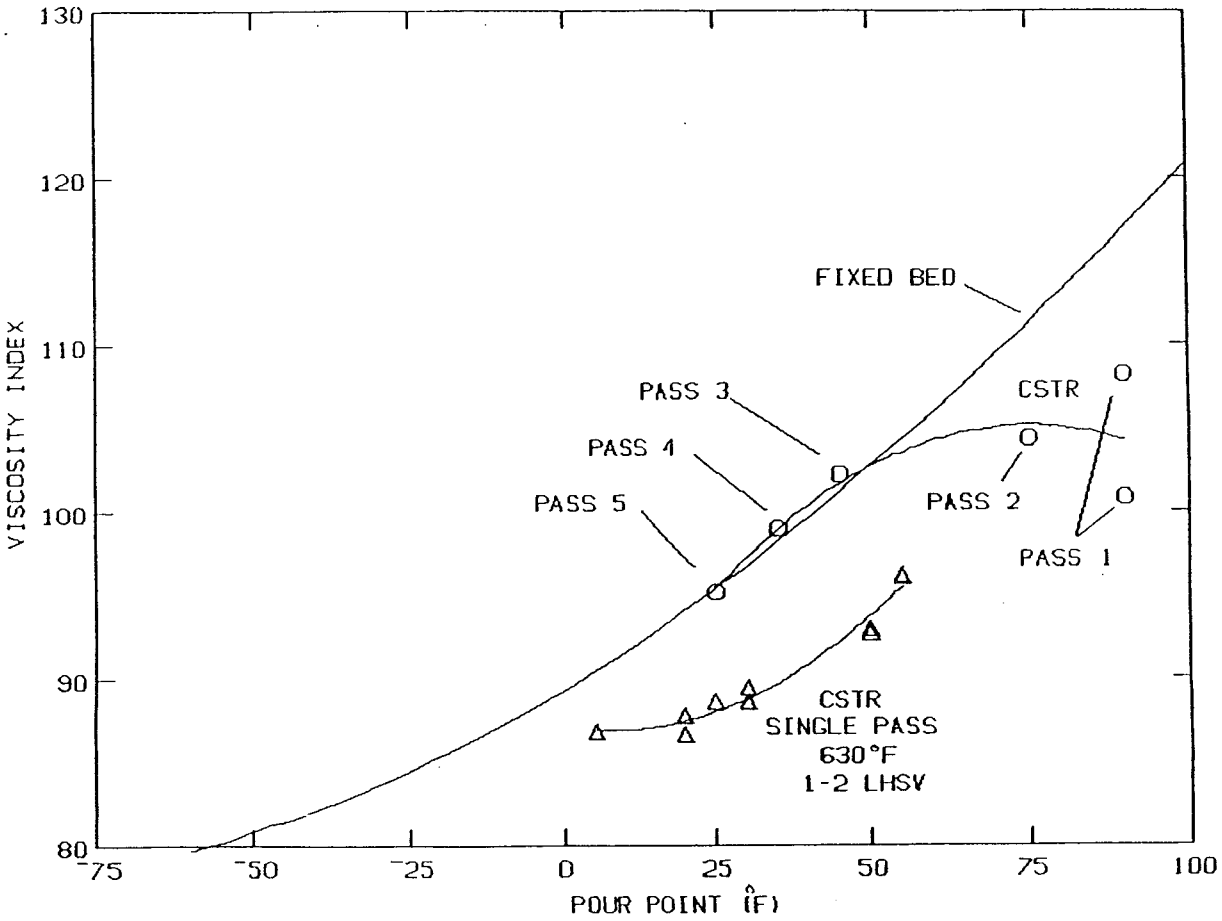
Figure 9:
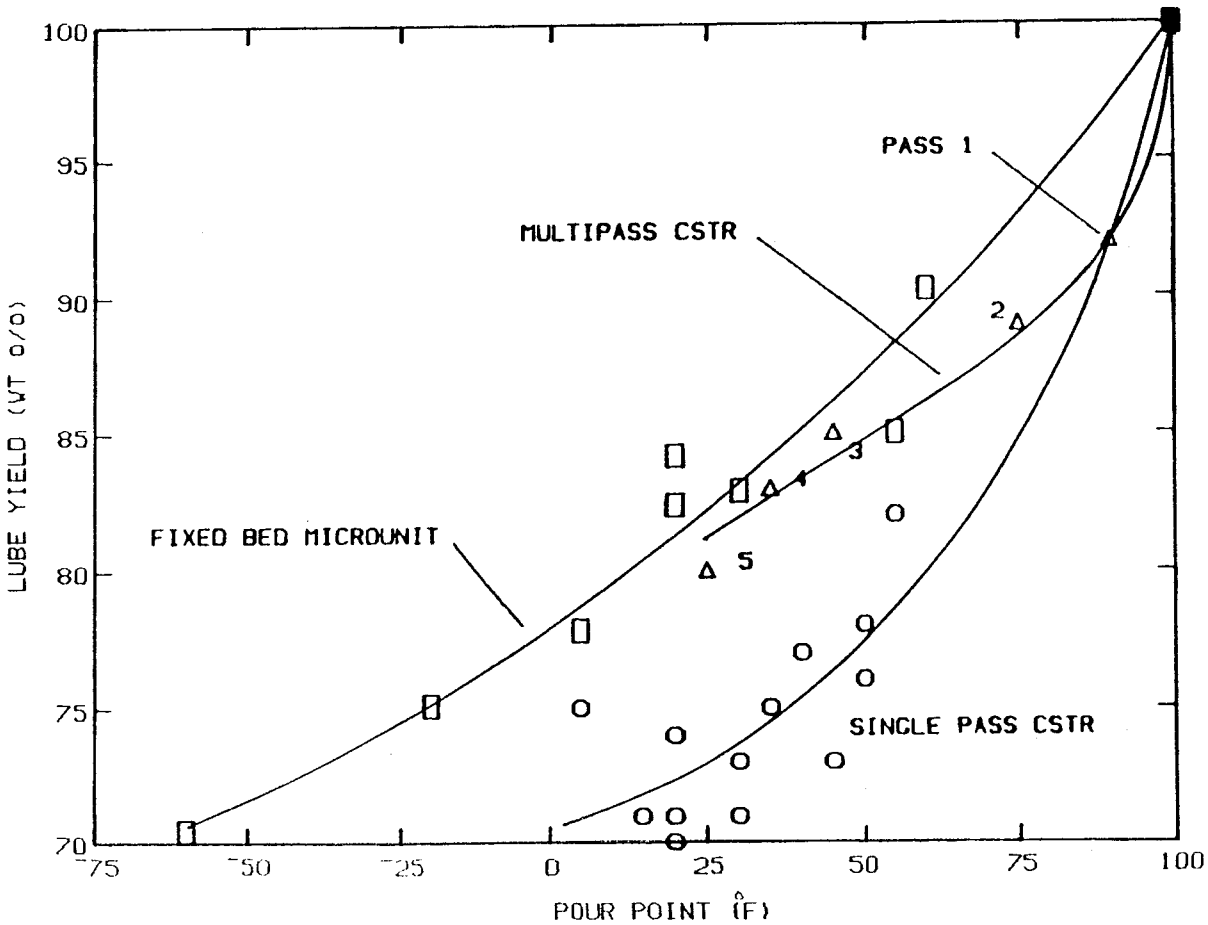

FIGS. 4 and 6 are plots illustrating the effect of pour point on lube yield for two different feedstocks for a fixed bed and a continuous stirred tank reactor;

FIGS. 5 and 7 are plots illustrating the effect of pour point on Viscosity Index for two different feedstocks for a fixed bed and a continuous stirred tank reactor; and FIGS. 8 and 9 compare the relationship between pour point and Viscosity Index (FIG. 8) and pour point and lube yield (FIG. 9) for a fixed bed reactor, a single stage continuous stirred tank reactor and a multi-stage continuous stirred tank reactor.

DETAILED DESCRIPTION OF THE PREFERRED EMBODIMENTS

Continuous Stirred Tank Reactor (CSTR)

Fixed bed reactors are commonly used in order to produce a lubricating oil having desirable qualities. It is generally believed that the fixed bed reactor is the most efficient way of producing such a lubricating oil. However, we have discovered that through the fixed bed reactor lubricating oil production may actually be hindered.

During the reaction, volatile products are also produced which foul the catalyst, slow the reaction process and hinder the dewaxing of the lubricating oil feedstock. Therefore, the volatile products must be removed before they further interfere with the reactor.

We searched for an efficient way to get rid of the secondary volatile products. Up to now, it was not thought that a CSTR could be used because of two major problems normally associated with such reactors. First, it was thought that immersing the catalyst in the liquid would reduce the effectiveness of hydrogen and cause fast catalyst deactivation, which are generally true for most reactions. Second, in a CSTR, there exists an inevitable reactor by-pass, resulting in an undesirable residence time distribution of the liquid in the reactor. The CSTR practices continuous feed and stirring in one vessel. In theory and practice, it has been found that a small fraction of the feed will pass through the reactor without ever reacting. For example, if the feed rate is one liquid hourly space velocity (LHSV) based on reactor volume, the average residence time of reaction in the reactor is one hour; but a small amount of feed may remain in the reactor for many hours and another small amount of unreacted feed may pass through the reactor within seconds. It is this unreacted feed which causes problems. The unreacted portion passing through the reactor is very damaging to the lube oil product, as it raises the pour point of the product. By blending a small portion of the raw undewaxed oil in the product, the pour point is substantially raised in a non-linear fashion, i.e., a small concentration of a high pour point material mixed with a large concentration of a low pour point material gives a higher pour point than the arithmetic average, and is therefore highly undesirable. For example, one would ordinarily assume that if 3% of 100° F. (37° C.) pour point feedstock was added to a 20° F. (−6.7° C.) pour point product, the ultimate product would have a pour point of about 20.5° F. (−6.4° C.). In actual practice, however, the product may have a pour point of 60° F. (12° C.) due to non-linear blending. Therefore, in order to make a 20° F. (−6.7° C.) pour point in one tank, it was assumed that the reaction conditions must be severe in order to accommodate for the by-passed reaction feedstock. However, we have discovered that the CSTR provides advantages over the fixed bed reactor which outweigh the disadvantages. These advantages are further enhanced by stacking more than one CSTR together in order to eliminate any possibility of unreacted feed being passed through the reactor.

Pursuant to particular features of the process of this invention, one type of useful reactor for this purpose is essentially a vertical reactor, preferably of the cylindrical type, wherein a cylindrical bed of catalyst material, such as crystalline zeolite, occupies a portion of the reactor. The bed may be mounted and, in an alternative embodiment, contained so that it can be agitated rapidly while submerged in a liquid oil phase. Liquid petroleum feedstock to be dewaxed is injected into the reactor, preferably at the bottom, and maintained primarily in a liquid phase as it permeates the bed of catalyst.

While the liquid feed stock is in contact with the catalyst bed, the catalyst bed is agitated and the dewaxing operation is carried out. If the catalyst bed is contained, it can be rotated rapidly while submerged. Preferably, hydrogen or other hydrocarbon-free gas is injected into the bottom of the tower so that it also flows upwardly through the feedstock and through the rotating cylindrical bed of catalyst. The gases generated in the dewaxing operation are collected at the top-most portion of the reactor, which is maintained in a free open configuration, so that the hydrogen gas bubbling through the liquid can enhance the degasification of the liquid oil phase. The oil is withdrawn at a point removed from the bed section of the reactor, and the gaseous phase is withdrawn at a higher level in the reactor.

Feedstock

Feedstocks which vary widely in their wax content can be dewaxed according to the process of this invention. One group of such oils is that which contains sufficient waxes to impart an undesirably high pour point. In general, such oils have a substantial fraction, i.e., at least about 10 vol %, which distills above 350° F. (176° C.). These oils, as a group, will be referred to herein as "waxy" oils, and include virgin petroleum crudes and fractions thereof, such as kerosene, jet fuel, light gas oil, heavy gas oil, fuel oils, and atmospheric and vacuum tower residua. Feedstocks which have been previously hydrotreated or hydrogenated, and which consequently contain little or no sulfur, can also be dewaxed by our process. The liquid feedstock preferably is a lube oil which has a boiling point between 650° and 1300° F. (343°–704° C.), and a pour point above 85° F. (29° C.). Shale oil, oil from tar sands and waxy syncrudes from coal may also be dewaxed in accordance with this invention.

Reaction Conditions

Typical dewaxing conditions include contacting the feedstock with the dewaxing catalyst at about 500° to 1100° F. (260°–593° C.), space velocity at about 0.1 to 100 LHSV, hydrogen-to-hydrocarbon mole ratio of about 0 to 20, and a pressure of about 100 to 3000 psig.

The important features of the present invention are as follows:

(1) operate at a low temperature range to reduce aging, i.e., temperature less than 700° F. (371° C.);

(2) the catalyst must be totally immersed in the liquid feedstock to be dewaxed;

(3) contact time between the catalyst and the product gases during the dewaxing step must be minimized; and (4) use of multiple reactors in series is recommended.

Description of the Drawings

Figure 1:
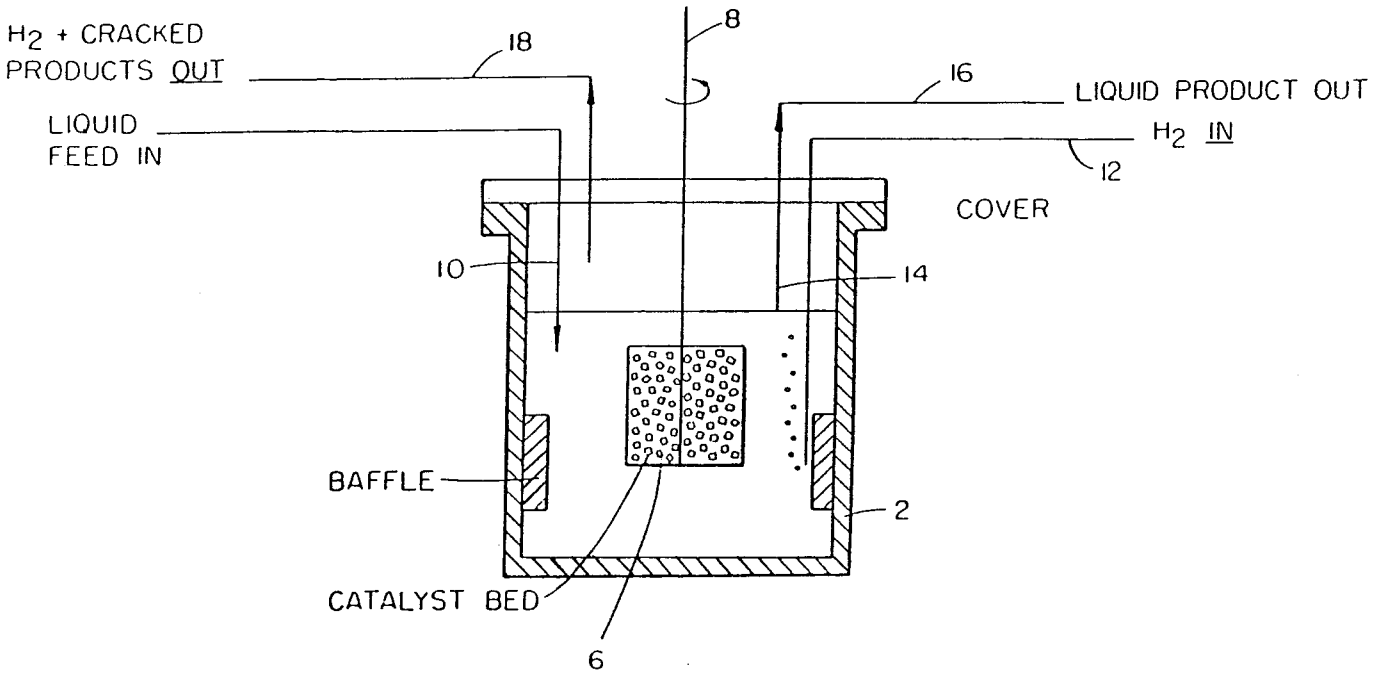
FIG. 1 depicts one type of reactor useful in the application of this invention.

Referring now in detail to an embodiment of a useful reactor illustrated in FIG. 1 of the drawings, the reactor consists essentially of an upright or vertically-arranged container or tower which can be of cylindrical construction and which has an outer cylindrical shell or wall 2, and an end cover structure.

Interposed in and filling the space, or at least a portion thereof, in the reactor is a cylindrical catalyst bed 6 of catalyst material which, in a preferred instance, is a shape-selective crystalline zeolite catalyst, preferably a supported metal-exchanged ZSM-5, although other zeolites, such as described in Pelrine et al, U.S. Pat. No. 4,222,855 and U.S. Pat. Re. No. 28,398, may also be suitably employed as the catalyst material.

The preferred catalysts for this invention are shape-selective zeolite-type catalysts. For purposes of this invention, the term "zeolite" is meant to represent the class of porotectosilicates, i.e., porous crystalline silicates, that contain silicon and oxygen atoms as the major components. Other components may be present in minor amounts, usually less than 14 mole %, and preferably less than 4 mole %. These components include aluminum, gallium, iron, boron and the like, with aluminum being preferred, and used herein for illustration purposes. The minor components may be present separately or in mixtures.

The silica-to-alumina mole ratio referred to may be determined by conventional analysis. This ratio is meant to represent, as closely as possible, the ratio in the rigid anionic framework of the zeolite crystal and to exclude aluminum in the binder or in cationic or other forms within the channels. Although zeolites with a silica-to-alumina mole ratio of at least 10 are useful, it is preferred to use zeolites having silica-to-alumina mole ratios of at least 20:1. In addition, zeolites, as otherwise characterized herein but which are substantially free of aluminum, i.e., having silica-to-alumina mole ratios up to and including infinity, are found to be useful and even preferable in some instances. The novel class of zeolites, after activation, acquire an intra-crystalline sorption affinity for normal hexane, which is greater than that for water, i.e., they exhibit "hydrophobic" properties.

A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g., less than 5 Angstroms. On the other hand, zeolites which provide relatively free access to the internal zeolite structure have a low value for the Constraint Index, and usually pores of large size, e.g., greater than 8 Angstroms. The method by which Constraint Index is determined is described fully in U.S. Pat. No. 4,016,218, incorporated herein by reference for details of the method.

Constraint Index (CI) values for some typical materials are:

| | CI | (At Test Temperature) |
|---|---|---|
| ZSM-4 | 0.5 | 316° C. |
| ZSM-5 | 6–8.3 | (371°–316° C.) |
| ZSM-11 | 6–8.7 | (371°–316° C.) |
| ZSM-12 | 2.3 | (316° C.) |
| ZSM-20 | 0.5 | (371° C.) |
| ZSM-22 | 7.3 | (427° C.) |
| ZSM-23 | 9.1 | (427° C.) |
| ZSM-34 | 50 | (371° C.) |
| ZSM-35 | 4.5 | (454° C.) |
| ZSM-38 | 2 | (510° C.) |
| ZSM-48 | 3.5 | (538° C.) |
| ZSM-50 | 2.1 | (427° C.) |
| TMA Offretite | 3.7 | (316° C.) |
| TEA Mordenite | 0.4 | (316° C.) |
| Clinoptilolite | 3.4 | (510° C.) |
| Mordenite | 0.5 | (316° C.) |
| REY | 0.4 | (316° C.) |
| Amorphous Silica-Alumina | 0.6 | (538° C.) |
| Dealuminized Y (Deal Y) | 0.5 | (510° C.) |
| Erionite | 38 | (316° C.) |
| Zeolite Beta | 0.6–2 | (316°–399° C.) |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g., temperature, as to establish more than one value for the Constraint Index of a particular zeolite. This explains the range of Constraint Indices for zeolites, such as ZSM-5, ZSM-11 and Zeolite Beta.

Zeolite ZSM-4 is taught by U.S. Pat. No. 3,923,639, the disclosure of which is incorporated herein by reference.

Zeolite ZSM-5 is taught by U.S. Pat. No. 3,702,886, and Re. No. 28,847, the disclosures of which are incorporated herein by reference.

Zeolite ZSM-11 is taught by U.S. Pat. No. 3,709,979, the disclosure of which is incorporated herein by reference.

Zeolite ZSM-12 is taught by U.S. Pat. No. 3,832,449, the disclosure of which is incorporated herein by reference.

Zeolite ZSM-18 is taught by U.S. Pat. No. 3,950,496, the disclosure of which is incorporated herein by reference.

Zeolite ZSM-20 is taught by U.S. Pat. No. 3,972,983, the disclosure of which is incorporated herein by reference.

Zeolite ZSM-23 is taught by U.S. Pat. No. 4,076,342, the disclosure of which is incorporated herein by reference.

Zeolite ZSM-34 is taught by U.S. Pat. No. 4,086,186, the disclosure of which is incorporated herein by reference.

Zeolite ZSM-35 is a synthetic ferrierite-type material described by U.S. Pat. No. 4,016,245, the disclosure of which is incorporated herein by reference.

Zeolite ZSM-38 is a synthetic ferrierite-type material described in U.S. Pat. No. 4,046,859, the disclosure of which is incorporated herein by reference.

Zeolite ZSM-48 is described in U.S. Pat. No. 4,397,827, the disclosure of which is incorporated herein by reference.

Zeolite Beta is described in U.S. Pat. Nos. 3,308,069 and Re. No. 28,341, the disclosures of which are incorporated herein by reference.

U.S. Pat. application Ser. No. 386,456 to Valyocsik dated June 8, 1982, which is incorporated herein by reference, discloses a synthetic porous crystalline material designated as zeolite ZSM-50, a method for its preparation and to its use in catalytic conversion of organic compounds.

Low sodium Ultrastable Y molecular sieve (USY) is described in U.S. Pat. Nos. 3,293,192 and 3,449,070, the disclosures of which are incorporated herein by reference.

It is to be realized that the above CI values typically characterize the specified zeolites, but that such are the cumulative result of several variables useful in the determination and calculation thereof. Thus, for a given zeolite exhibiting a CI value within the range of 1 to 12, depending on the temperature employed during the test method within the range of 555° F. (290° C.) to 1000° F. (538° C.), with accompanying conversion between 10 and 60%, the CI may vary within the indicated range of 1 to 12. Likewise, other variables such as the crystal size of the zeolite, the presence of possibly occluded contaminants and binders intimately combined with the zeolite may affect the CI. It will accordingly be understood to those skilled in the art that the CI, as utilized herein, while affording a highly useful means for characterizing the zeolites of interest is approximate, taking into consideration the manner of its determination, with the possibility, in some instances, of compounding variable extremes. However, in all instances, at a temperature within the above-specified range of 555° F. (290° C.) to 1000° F. (538° C.), the CI will have a value for any given zeolite of interest herein within the approximate range of 1 to 12.

Zeolites useful in the present invention are termed medium or intermediate pore zeolites and have a Constraint Index generally between 1 and 12, and an effective pore size of generally not greater than about 7 Angstroms, such as to freely sorb normal hexane. In addition, the structure must provide constrained access to larger molecules. It is sometimes possible to judge from a known crystal whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA Offretite does show some constrained access. Other 12-ring structures may exist which may be operative for other reasons, and therefore, it is not the present intention to entirely judge the usefulness of a particular zeolite solely from theoretical structural considerations.

The preferred medium pore zeolites in this invention include those having the structure of ZSM-5, ZSM-11, ZSM-12, ZSM-23, ZSM-35, ZSM-38, ZSM-48, and other similar materials, with ZSM-5 being particularly preferred.

The zeolites used as catalysts in this invention may be in the hydrogen form or they may be base-exchanged or impregnated to contain ammonium or a metal cation complement. It is desirable to calcine the zeolite after base-exchange. The metal cations that may be present include any of the cations of the metals of Groups I through VIII of the Periodic Table. However, in the case of Group IA metals, the cation content should in no case be so large as to effectively inactivate the catalyst. For example, a completely sodium-exchanged H-ZSM-5 is largely inactive in the present invention.

It is to be understood that the exact configuration of the cylindrical catalyst bed need not be cylindrical. The catalyst bed can be, for example, supported in part on trays arranged along the axis of the reactor, or can be a single continuous body. The important feature of the catalyst bed is that it be completely submerged in the petroleum liquid being dewaxed and that it be designed to minimize the contact time between catalyst and the product gases formed during the dewaxing step. To this end, in the embodiment shown here, the catalyst bed is designed to be rotated rapidly around axial support 8 to effect disengagement of gases on the catalyst. The speed of revolution is easily determined by preliminary testing prior to going on-stream. Inlet line 10 for a liquid petroleum feedstock extends into the reactor so as to allow feedstock to flow through the catalyst bed, thereby completely submerging the catalyst in the oil phase. Also provided is a line 12 for the injection of a gas, preferably hydrogen, which is bubbled up through the catalyst bed and the oil phase permeating therethrough. The effect of the injected gas is to degasify the liquid being treated so that the gases formed during the dewaxing operation are more freely liberated from the oil phase. The oil phase is then carried off at a point 14 through line 16 above the catalyst bed and from the reactor. Gases accumulating in the top of the reactor are removed through exit line 18. Multiple towers may be employed, whereby each tower is a separate stage in which the liquid product from one stage is directed to a successive stage.

The effect of this particular reactor configuration is to achieve removal of cracked products from contact with the catalyst in oil as expeditiously and completely as possible, thereby avoiding further reaction of the cracked products, such as polymerization, or further cracking to lighter, less desirable gases. Details of heat control within the reactor system have not been included, since such does not form part of the invention.

One limitation which has been found during catalytic dewaxing of hydrocarbons using shape-selective zeolite catalysts is the aging rate of the catalyst. It has now been found that by operating a dewaxing reactor within the narrow low temperature range of 540° F. (282° C.) to less than 565° F. (296° C.), it is possible to significantly reduce catalyst aging. The above-defined temperature range is high enough so as to effect a significant reduction in the pour point of the product, typically equal to or less than about 20° F. (−6.7° C.), but not so high as to cause catalyst deactivation and require daily increases of temperature to boost catalyst activity. The exact temperature at which aging stops and the temperature at which aging continues may vary depending on the specific catalyst used. However, regardless of catalyst, within the narrow temperature range defined above, aging of the catalyst stops. This is characterized by meeting product specifications, such as pour point, without the need for daily increase in temperature.

While the embodiment utilizing a rotating bed of catalyst has been illustrated and described, it will be understood by those skilled in the art that changes and modifications, such as use of an agitating or ebullating bed of catalyst, may be resorted to without departing from the spirit and scope of the invention.

EXAMPLE 1

To demonstrate the performance of an immersed catalyst dewaxing process, the dewaxing of a bright stock raffinate using an isothermal trickle bed reactor was compared with the dewaxing of the same stock using the identical catalyst in a one-liter, continuous-flow stirred tank reactor. The reactor had the same configuration as described above. Properties of the feedstock are shown in Table 1 below. The catalyst was a 1.6 mm diameter extrudate of nickel-exchanged ZSM-5 zeolite and alumina in a ratio of 65 parts by weight zeolite to 35 parts by weight alumina. Prior to nickel-exchange, the catalyst was steamed for 6 hours at 900° F. (482° C.) to reduce the catalyst alpha to 70. The catalyst was contained in a wire mesh basket which rotated at a speed of 150 rpm in order to provide intimate contact between the bright stock and the catalyst.

The acid activity of zeolite catalysts is conveniently defined by the alpha scale, described in an article published in *Journal of Catalysis,* Vol. VI, pages 278–287 (1966). In this test, the zeolite catalyst is contacted with hexane under conditions prescribed in the publication and the amount of hexane which is cracked is measured. From this measurement is computed an "alpha" value which characterizes the catalyst for its cracking activity for hexane. The entire article above referred to is incorporated herein by reference. The alpha scale so described will be used herein to define activity levels for cracking n-hexane. And, in particular, for purposes of this invention, a catalyst with an alpha value of less than about 10, and preferably less than about 1, will be considered to have substantially little activity for cracking n-hexane.

Prior to contacting with the bright stock feed, the catalyst was sulfided in 2% $H_2S$/98% $H_2$ by progressively raising the temperature to 650° F. (343° C.) over the course of 6 hours. The catalyst was then cooled to 540° F. (282° C.) and the bright stock was introduced. The initial product had a very low pour point, i.e., −15° F. (−26° C.). The reactor temperature was maintained at 540° F. (282° C.) for 12 days until the pour point increased to 20° F. (−6.67° C.). For the remaining 34 days, the reactor temperature was adjusted to maintain the desired 20° F. (−6.67° C.) pour point. Catalyst aging rate was 2.2° C./day.

Figure 2:
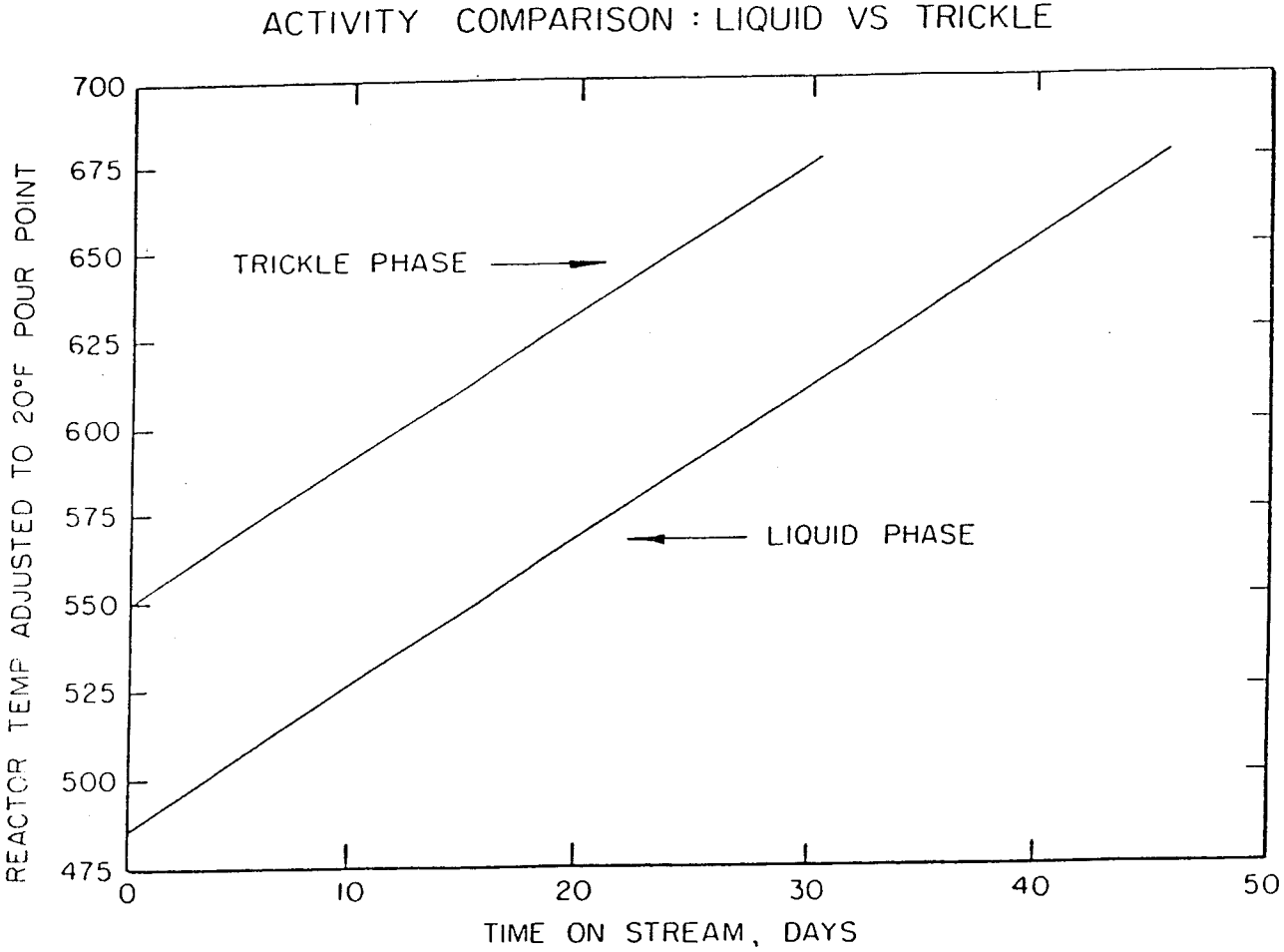
FIG. 2 is a plot comparing the activity of a dewaxing catalyst used according to the prior art with the activity of a catalyst used according to the process of this invention.

Other operating parameters of the system are given in Table 2. The performance of the immersed catalyst and that of the trickle bed process are compared in FIG. 2. Here, the relative activities and aging rates of the catalysts are compared on the basis of the reactor temperature required to attain a pour point of 20° F. (−6.67° C.). Throughout both the trickle bed and the continuous-flow stirred tank reactor runs a correction of +1° C. reactor temperature equaling −1° C. pour point was applied based on pour point analysis of the 400° C.+ liquid product to produce the adjusted reactor temperature, as shown in FIG. 2. From these data, it is apparent that the immersed catalyst process is superior to the trickle bed process, both in utilizing catalyst activity, as indicated by the lower process starting temperature of 484° F. (251° C.) as compared to 551° F. (288° C.), and the cycle length of the catalyst, as indicated by the number of days-on-stream (46 vs. 30 days-on-stream). Table 3 shows the product distribution comparing the liquid phase and the trickle bed processes.

TABLE 1

| | |
|---|---|
| API | 25.8 |
| Viscosity | |
| KV at 100° C. (CS) | 27.03 |
| KV at 148.9° C. (CS) | 8.50 |
| Sulfur, Wt % | 1.18 |
| Nitrogen, ppm | 200 |
| Hydrogen, Wt % | 13.03 |
| Aniline Point, °C. | 120.6 |
| Mass Spec Analysis, Wt % | |
| Paraffins | 18.3 |
| Mononaphthenes | 13.4 |
| Polynaphthenes | 20.9 |
| Aromatics | 47.4 |
| Nickel, ppm | 0.18 |
| Vanadium, ppm | 0.14 |
| Iron, ppm | 2.3 |
| Copper, ppm | 0.10 |
| Sodium, ppm | 4.10 |
| Pentane Insolubles, % | 2.07 |
| Distillation | |
| IBP, °C. | 434 |
| 5 | 478 |
| 10 | 493 |
| 30 | 516 |
| 50 | 551 |
| 70 | 582 |

TABLE 2

Operational Parameters of Trickle Bed and Immersed Catalyst Reactors

| | Immersed Catalyst | Trickle Bed |
|---|---|---|
| Reactor | R X R | R X R |
| Volume | 1 Liter | |
| ID | | 1.26 cm |
| Pressure | 500 psi | 400 psi |
| Liquid Hourly Space Velocity | | |
| LHSV, $HR^{-1}$ | 0.65 | 0.50 |
| Catalyst Loading, Grams | 18.6 | 85 |
| Volumetric Feed Rate, cc/hr | 19.5 | 170 |

TABLE 3

Product Distribution, Wt %

| | Trickle Bed | Liquid Phase |
|---|---|---|
| Methane | 0.04 | 0.06 |
| Ethane/Ethylene | 0.09 | 0.21 |
| Propene | 0.03 | 0.22 |
| Propane | 2.13 | 2.05 |
| Total Dry Gas | 2.29 | 2.54 |
| Isobutane | 1.37 | 1.75 |
| Butenes | 0.03 | 0.86 |
| n-Butane | 1.44 | 0.94 |
| Total $C_4$'s | 2.84 | 3.55 |
| Total $C_5$'s | 1.98 | — |
| Naphtha, $C_6$+ | 3.20 | 8.70 |
| Lube | 89.69 | 85.20 |

Distributions are given as weight %

EXAMPLE 2

The effect of using an unsteamed nickel-free ZSM-5/$Al_2O_3$ catalyst in conjunction with a lower start-up temperature to produce the reduced aging effect described above was demonstrated during the following experiment. The same 1-liter continuous-flow stirred tank reactor used in the above example was used for this run. Thirty cc of an unsteamed nickel-free 65 wt % ZSM-5/35 wt % $Al_2O_3$, having an alpha of approximately 260, was charged to a supported stainless steel basket. The catalyst was then immersed in a bright stock feed having the properties shown in Table 4, and the reactor temperature was raised rapidly to 480° F. (248.9° C.). Conversion of the feed was carried out at 1 LHSV, 2851 to 3196 kPa (400–450 psig), and 2500 Scf/Bbl $H_2$.

Figure 3:
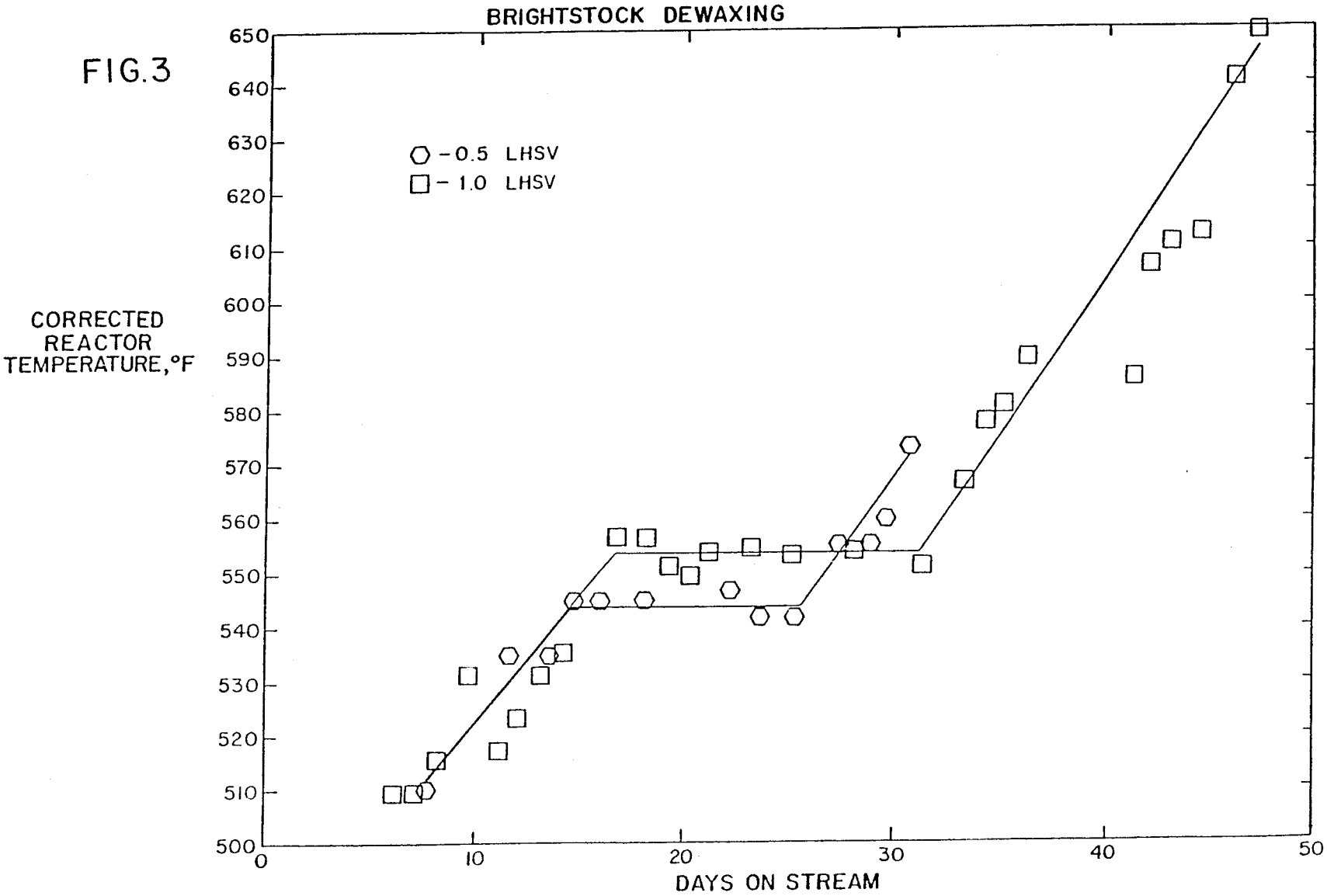
FIG. 3 is a plot illustrating the reactor temperature required to maintain a pour point of 20° F. (−6.7° C.) relative to the days-on-stream of two dewaxing catalysts. The corrected temperature is the actual reactor temperature plus the difference between the actual pour point of the product and the target pour point (20° F.)

After start-up at 480° F. (248.9° C.) resulted in a product that did not meet the 20° F. (−6.67° C.) pour point specification, the temperature was increased to approximately 520° F. (271.1° C.). At this temperature, the pour point easily met specifications, but the catalyst aged. Reactor temperature was increased to 555° F. (290.6° C.), at which point the product pour point remained steady at approximately 20° F. (−6.67° C.) for about 14 days. Partway through this "line-out", however, the temperature was arbitrarily raised to 565° F. (296.1° C.) in an attempt to reduce the pour point below 20° F. (−6.67° C.). Instead, the catalyst responded by resuming to age at a rate approximately equal to that observed prior to the line-out. This is shown in FIG. 3.

TABLE 4

| Properties of Bright Stock | |
|---|---|
| API Gravity | 26.0 |
| Viscosity | |
| KV at 100° C. | 28.19 |
| KV at 300° F. | 8.865 |
| Sulfur, Wt % | 1.22 |
| Nitrogen, ppm | 300 |
| Carbon Residue, % | 0.76 |
| Hydrogen, Wt % | 13.00 |
| Aniline Point, °F. | 247 |
| RI at 70° C. | 1.47758 |
| Furfural, ppm | 7 |
| Mass Spec., Wt % | |
| Paraffins | 19.8 |
| Mononaphthenes | 12.2 |
| Polynaphthenes | 21.0 |
| Aromatics | 47.0 |
| Metals, ppm | |
| Ni | 0.10 |
| V | 0.10 |
| Fe | 1.1 |
| Cu | 0.10 |
| Na | 4.4 |
| Pentane Insolubles | 1.26 |
| Distillation, °F. | |
| IBP | 767 |
| 5 | 850 |
| 10 | 873 |
| 30 | 919 |
| 50 | 960 |
| 70 | 1012 |

EXAMPLE 3

The same feedstock as described in Example 2 was dewaxed with a steamed nickel-containing ZSM-5 catalyst, having an alpha value of 70, at conversion conditions identical with that of Example 2, except space velocity was 0.5 LHSV. Prior to contact with the feed, the catalyst was sulfided as in Example 1. The "line-out", as described in Example 2, was also found in this Example. Here, however, the line-out temperature was 545° F. (285° C.) and aging resumed when the temperature was raised to 550° F. (288° C.). Although the line-out temperature and temperature at which aging resumed are slightly lower than in Example 2, there still is found a narrow temperature range in which catalyst aging is extremely slow.

EXAMPLES 4 AND 5

These examples compare a fixed bed unit with a one-stage CSTR. The experiments were carried out in a 1-liter autoclave equipped with three stainless steel baskets which contained the catalyst and were attached to the stirring shaft of the autoclave. The catalyst is a steamed 1% nickel ZSM-5 containing catalyst, having an alpha of about 70, similar to that disclosed in Example 1. 8.6 grams (15 $cm^3$) of the catalyst was immersed in 130 $cm^3$ of oil, which gave an average residence time in the reactor 8.7 times the space time (1/LHSV) based on the catalyst. The properties of the feedstocks are given in Table 5. The catalyst was sulfided in 2% $H_2S$ in 98% $H_2$, according to the following schedule, at atmospheric pressure: 450° F. (232° C.) for 1 hour, 550° F. (288° C.) for 1 hour, and 650° F. (343° C.) for 2 hours. The temperature was then dropped to 400° F. (204° C.), $H_2S$ flow was stopped, and $H_2$ flow started at 400 psig. The reactor was flooded with oil at no less than 10 LHSV and temperature was raised to 530° F. (277° C.). Flow was reset at 2 LHSV and $H_2$ at 2500 Scf/Bbl. Tables 5 and 6 list the experimental data obtained for the two feeds.

FIGS. 4 and 5 show the relationship between pour point, Viscosity Index and lube yield for feed A in the CSTR and fixed bed reactors. It is clear from this experiment that, for feed A, both yield and Viscosity Index for products from the CSTR are lower than that from the fixed bed reactor. FIGS. 6 and 7, on the other hand, show that, for feed B, there is good agreement between fixed bed and CSTR results. These data are in lower pour point regime than the feed A data, because the target pour for feed B is 50° F. (10° C.) lower than that for feed A. This suggests that the deviation between CSTR and fixed bed results decreases at low pour points. Although not wishing to be held to one theory, it does appear that at very low pour points, or where long-chain paraffins are in low concentration, as in feed B, a type of reactor or the reactor hydrodynamics does not have as significant an effect on product Viscosity Index or lube yield.

Thus, there is a clear difference in the response of different feeds to dewaxing in a CSTR. The product from feed A heavy neutral is lower in yield and Viscosity Index compared to fixed bed, while the product from the severely hydrotreated and previously solvent dewaxed feed B light neutral has the same yield and Viscosity Index from both the CSTR and fixed bed reactor. These results suggest that once the bulk of the long-chain linear paraffins have been removed, i.e., at low pour points, Viscosity Index and lube yield are not are not as sensitive to residence time distribution differences. Therefore, under certain conditions, a one-stage CSTR achieves, at the very least, the same results as a fixed bed reactor. Combined with the other advantages of the CSTR, as disclosed elsewhere in this application, it is apparent that the CSTR is advantageous, at least with certain types of feedstock.

TABLE 5

| Severely Hydrotreated Feedstock Properties | Example 4 Feed A | Example 5 Feed B |
|---|---|---|
| API Gravity | 31.0 | 32.2 |
| Pour Point, °F. | 115 | 5 |
| Cloud Point, °F. | 120 | 5 |
| Flash Point, °F. | 520 | 425 |
| KV at 40° C. | 39.74* | 30.80 |
| KV at 100° C. | 10.00 | 5.348 |
| SUS at 100° F. | 383 | 158.8 |
| SUS at 210° F. | 60.2 | 44.2 |
| Viscosity Index | 116 | 107 |
| Sulfur, ppm | 64 | 1 |
| Nitrogen, ppm | 7 | **0.2 |
| Hydrogen, Wt % | 14.26 | 14.48 |
| Aniline Point, °F. | 248 | 228.5 |
| Bromine Number | 0.2 | 0.1 |
| Total Acid Number | 0.038 | **0.01 |
| CCR, Wt % | **0.01 | **0.01 |
| Distillation | D1160 | D1160 |
| IBP, °F. | 738 | 648 |
| 5 | 851 | 708 |
| 10 | 874 | 728 |
| 30 | 905 | 767 |
| 50 | 918 | 800 |
| 70 | 934 | 829 |
| 90 | 963 | 868 |
| 95 | 971 | 884 |

*At 130° F.
**Less Than

TABLE 6

Example 4
Hydrodewaxing of Feed A in a CSTR

| Material Balance | 1 | 3 | 4 | 5 | 6 | 7 |
|---|---|---|---|---|---|---|
| Days-on-Stream | 1.4 | 2.3 | 3.4 | 4.3 | 5.8 | 7.2 |
| Temperature, °F. | 619 | 626 | 579 | 579 | 579 | 579 |
| LHSV | 0.7 | 0.6 | 1.0 | 1.0 | 0.9 | 0.9 |
| Lube Yield, % | 43 | 49 | 63 | 69 | 66 | 69 |
| Herzog Pour, °C. | *−30 | *−30 | −17.4 | −16.7 | −17.8 | −18.2 |
| D97 Pour, °F. | −5 | −35 | 20 | 20 | 15 | 15 |
| Cloud Point, °F. | 50 | −10H | 54 | 54 | 48 | 52H |
| KV at 40° C. | 92.50 | 113.9 | 100.8 | 103.8 | 106.7 | 99.41 |
| KV at 100° C. | 10.22 | 11.22 | 11.13 | 11.32 | 11.47 | 11.02 |
| Viscosity Index | 89.7 | 80.5 | 95.0 | 94.5 | 93.5 | 95.0 |

*Less Than

TABLE 7

Example 5
Hydrodewaxing of Feed B in a CSTR

| Material Balance | 1 | 2 | 3 | 4 | 5 |
|---|---|---|---|---|---|
| Days-on-Stream | 0.6 | 1.0 | 1.6 | 3.2 | 4.6 |
| Temperature, °F. | 531 | 531 | 531 | 540 | 561 |
| LHSV | 2.0 | 1.1 | 1.2 | 1.1 | 1.1 |
| Lube Yield, % | 65 | 91 | 85 | 83 | 78 |
| Herzog Pour, °C. | −44.6 | −44.7 | −44.0 | −43.0 | −47.8 |
| D97 Pour, °F. | −50 | −45 | −40 | −40 | −60 |
| Cloud Point, °F. | −48 | −48 | −42 | −44 | −60 |
| KV at 40° C. | 36.39 | 35.33 | 35.06 | 36.42 | 36.23 |
| KV at 100° C. | 5.711 | 5.592 | 5.595 | 5.708 | 5.664 |
| Viscosity Index | 94.3 | 93.3 | 95.2 | 93.9 | 92.4 |

| Material Balance | 6 | 7 | 8 | 9 |
|---|---|---|---|---|
| Days-on-Stream | 5.4 | 6.6 | 7.4 | 8.4 |
| Temperature, °F. | 595 | 507 | 507 | 509 |
| LHSV | 1.1 | 1.1 | 1.1 | 1.1 |
| Lube Yield, % | 72 | 97 | 91 | 94 |
| Herzog Pour, °C. | *−50 | −38.5 | −30.9 | −29.1 |
| D97 Pour, °F. | *−65 | −40 | −25 | −20 |
| Cloud Point, °F. | *−65 | −38 | −20 | −16 |
| KV at 40° C. | 37.87 | 35.99 | 34.66 | 34.07 |
| KV at 100° C. | 5.758 | 5.660 | 5.600 | 5.600 |
| Viscosity Index | 88.6 | 93.6 | 97.9 | 101.3 |

*Less Than

EXAMPLE 6

The following example compares a multiple-stage CSTR with a fixed bed reactor. This experiment was conducted utilizing the same equipment described in Examples 4 and 5. The only variable significantly changed was the space velocity, which was varied between 1.5 and 4.0 LHSV. The temperature was maintained between 626° and 631° F. (330° and 333° C.), the pressure was 400 psig, $H_2$ flow was 250 $cm^3$/min. The feedstock was a light neutral stock, the characteristics of which can be found in Table 8. The catalyst is substantially identical to that described in Examples 4 and 5. The feed was passed over the catalyst in five successive passes. The initial three passes were made at 4.0 LHSV. The fourth and fifth passes were at 2.8 and 1.5 LHSV, respectively, in an attempt to reach a target pour point of 20° F. (−6.7° C.) despite catalyst aging. The lube product (610° F.+) from each pass was recombined with its respective light liquid product ($C_5$-610° F.), and refed to the charge buret for the next pass. In this way, only the gas was not recycled. Pour points and viscosities were measured on samples of the lube product from each pass, and the data along with the operating conditions are listed in Table 8.

FIG. 8 shows the Viscosity Index/pour point relationship for the products compared to fixed bed results (data results not listed), and the single pass CSTR data for the same feed. As illustrated in FIG. 8, after one or two passes, it can be seen that the Viscosity Index of the product was lower than that of the fixed bed product of the same pour point. However, after three passes, the Viscosity Index reached the fixed bed line and remained there as the pour point decreased. FIG. 9 shows that product yield behaves in a similar fashion, approaching the fixed bed operating line after about three passes.

Thus, two independent measurements, i.e., Viscosity Index and lube yield, all approach the fixed bed results after three passes in the CSTR. It therefore appears that the lower single-pass results in the CSTR were due to the mixing/by-passing characteristics of the CSTR. This supports the hypothesis that by-passing in a CSTR could contribute to both yield and Viscosity Index loss for light neutral products.

TABLE 8

Multiple-Pass CSTR Run
Hydrodewaxing at 400 psig

| Pass | Feed | 1 | 2 | 3 | 4 | 5 |
|---|---|---|---|---|---|---|
| Temperature, °F. | — | 631 | 631 | 626 | 626 | 626 |
| LHSV | — | 4.1 | 3.9 | 4.0 | 2.8 | 1.5 |
| Cumulative Lube Yield, % | 100 | 92 | 89 | 85 | 83 | 80 |
| Product Properties | | | | | | |
| Herzog Pour, °C. | 33.0 | 27.4[a] 29.2[a] | 11.8 | 5.9 | 0.7 | −7.2 |
| D-97 Pour, °F. | 100 | 90 90 | 75 | 45 | 35 | 25 |
| Cloud Point, °F. | 118 | 100 100 | 84 | 76 | 60 | 42 |
| KV at 40° C. | 30.43 | 33.83 33.28 | 34.67 | 36.44 | 38.88 | 41.52 |
| KV at 100° C. | 5.540 | 5.703 5.509 | 5.722 | 5.864 | 6.050 | 6.232 |
| Viscosity Index | 121 | 108 101 | 104 | 102 | 99 | 95 |

[a]Two samples taken from Pass 1

In summary, the present invention relates to a process for dewaxing a petroleum feedstock which involves reacting a continuous liquid phase with a submerged catalyst contained in the liquid phase. A discontinuous gaseous phase is passed up through the liquid phase to strip the liquid of undesirable secondary reaction products that are more volatile than the feedstock, but which have finite solubility in the liquid phase. It would not have been apparent to use prior art ebullating reactors, because these reactors provide less hydrogen for the reaction than do more conventional trickle bed reactors, and because such reactors are known to have inherent by-passing, which is deleterious to the pour point target required for the product specification. In spite of these theorized shortcomings, it has been found that the continuous liquid phase with submerged catalyst is superior to the conventional three-phase trickle bed or the fixed bed reactors.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. A process for dewaxing a hydrocarbon feedstock in a dewaxing system, which comprises:

(a) contacting in said system a liquid hydrocarbon fraction boiling in the range of 650° to 1300° F. and having a pour point of above about 85° F. in a liquid-solid contact with a solid dewaxing catalyst under conditions of temperature and pressure sufficient to effect dewaxing of said feedstock, said temperature being less than 700° F., thereby also forming hydrocarbon gases in contact with said catalyst;

(b) providing an enclosing means and forming an enclosed catalyst bed within said enclosing means, mounting said enclosing means in said system so as to maintain said enclosed catalyst bed submerged in said feedstock;

(c) continuously removing said hydrocarbon gases from contact with said catalyst by rotating said enclosing means containing said catalyst bed;

(d) removing a dewaxed hydrocarbon fraction from said catalyst; and (e) separating said hydrocarbon gases from said dewaxed hydrocarbon fraction and separately withdrawing said dewaxed hydrocarbon fraction and said hydrocarbon gases from said dewaxing system.

2. The process of claim 1, wherein said dewaxing catalyst is an intermediate pore shape-selective zeolite.

3. The process of claim 2, wherein said shape-selective zeolite catalyst is selected from crystalline aluminosilicate zeolites characterized by a Constraint Index of about 1–12.

4. The process of claim 3, comprising dewaxing said feedstock at a temperature sufficient to provide a pour point of no greater than 20° F. and which allows said catalyst to maintain said pour point without daily increases in temperature.

5. The process of claim 1, comprising dewaxing said feedstock at a temperature in the range from about 540° to about 565° F.

6. The process of claim 1, wherein said submerged catalyst is in a catalyst bed which is rotated within said liquid feedstock.

7. The process of claim 1, wherein said submerged catalyst is a bed of catalyst extrudate.

8. The process of claim 7, wherein said catalyst extrudate is a supported intermediate pore zeolite selected from the group having the characteristics of ZSM-5, ZSM-11, ZSM-12, ZSM-23, ZSM-35, ZSM-38 and ZSM-48.

9. The process of claim 1, wherein said fraction boils in the range of 650° to 1300° F.

10. The process of claim 1, wherein said system is purged by passing a hydrocarbon-free gas within said fraction.

11. The process of claim 1, wherein said dewaxing system is a continuous stirred tank reactor.

12. The process of claim 11, wherein said dewaxing system is composed of multiple continuous stirred tank reactors.

13. The process of claim 12, wherein said dewaxing system contains at least three continuous stirred tank reactors in series.

14. A process for dewaxing a hydrocarbon feedstock in a dewaxing system, which comprises:

(a) contacting in said system a liquid hydrocarbon fraction boiling in the range of 650° to 1300° F. and having a pour point of above about 85° F. in a liquid-solid contact with a solid dewaxing catalyst under conditions of temperature and pressure sufficient to effect dewaxing of said feedstock, thereby also forming hydrocarbon gases in contact with said catalyst;

(b) providing an enclosing means and forming an enclosed catalyst bed within said enclosing means, mounting said enclosing means in said system so as to maintain said enclosed catalyst bed submerged in said feedstock;

(c) continuously removing said hydrocarbon gases from contact with said catalyst by rotating said enclosing means containing said catalyst bed;

(d) removing a dewaxed hydrocarbon fraction from said catalyst bed and purging a gaseous phase from said system with hydrocarbon-free gas.

15. A process for dewaxing a hydrocarbon feedstock in a dewaxing system which comprises:

(a) contacting in said system a waxy liquid hydrocarbon fraction in a liquid-solid contact with a solid dewaxing catalyst under conditions of temperature and pressure sufficient to effect dewaxing of said feedstock, thereby also forming hydrocarbon gases in contact with said catalyst;

(b) providing an enclosing means and forming an enclosed catalyst bed within said enclosing means, mounting said enclosing means in said system so as to maintain said enclosed catalyst bed submerged in said feedstock;

(c) continuously removing said hydrocarbon gases from contact with said catalyst by rotating said enclosing means containing said catalyst bed;

(d) removing a dewaxed hydrocarbon fraction from said catalyst bed and purging a gaseous phase from said system.

16. The process of claim 15, wherein said dewaxing catalyst is an intermediate pore shape-selective zeolite.

17. The process of claim 16, wherein said shape-selective zeolite catalyst is selected from crystalline aluminosilicate zeolites characterized by a Constraint Index of about 1–12.

18. The process of claim 17, comprising dewaxing said feedstock at a temperature sufficient to provide a pour point of no greater than 20° F. and which allows said catalyst to maintain said pour point without daily increases in temperature.

19. The process of claim 18, comprising dewaxing said feedstock at a temperature in the range from about 540° to less than 565° F.

20. The process of claim 1, wherein said submerged catalyst is a bed of catalyst extrudate.

21. The process of claim 20, wherein said catalyst extrudate is a supported intermediate pore zeolite selected from the group consisting of ZSM-5, ZSM-11, ZSM-12, ZSM-23, ZSM-35, ZSM-38 and ZSM-48.

22. The process of claim 21, wherein said fraction boils in the range of 650° to 1300° F.

23. The process of claim 20, wherein said system is purged by passing a hydrocarbon-free gas within said fraction.

24. The process of claim 15, wherein said fraction boils in the range of 650° to 1300° F.

25. A process for dewaxing a hydrocarbon feedstock in a dewaxing system, which comprises:

(a) contacting in said system a hydrogenated or hydrotreated liquid hydrocarbon fraction in a liquid-solid contact with a solid dewaxing catalyst under conditions of temperature and pressure sufficient to effect dewaxing of said fraction, thereby also forming hydrocarbon gases in contact with said catalyst;

(b) providing an enclosing means and forming an enclosed catalyst bed within said enclosing means, mounting said enclosing means in said system so as to maintain said enclosed catalyst bed submerged in said feedstock;

(c) continuously removing said hydrocarbon gases from contact with said catalyst by rotating said enclosing means containing said catalyst bed;

(d) removing a dewaxed hydrocarbon fraction from said catalyst bed and purging a gaseous phase from said system with hydrocarbon-free gas.

26. A process for dewaxing and desulfurizing a liquid hydrocarbon fraction in a reactor, which comprises:

(a) providing a means to form an enclosed catalyst bed of dewaxing catalyst and mounting said means in a reactor containing a reaction zone;

(b) providing above said catalyst bed a degassing zone;

(c) contacting said catalyst bed with a liquid hydrocarbon fraction to be catalytically dewaxed to a level where said catalyst is completely submerged in said liquid hydrocarbon fraction;

(d) flowing a gas through said liquid hydrocarbon fraction;

(e) continuously rotating said means enclosing said catalyst bed while said bed is in contact with said liquid hydrocarbon fraction;

(f) removing said liquid fraction from the reactor at a point above said submerged catalyst bed; and (g) collecting and removing hydrocarbon gas from said degassing zone with a gaseous stream.

27. In a process for dewaxing a gas oil in a dewaxing system, which comprises contacting said gas oil with a bed of zeolite catalyst in the presence of hydrogen under conditions of temperature and pressure sufficient to effect dewaxing of said oil, said process forming hydrocarbon gases in contacting with said catalyst, the improvement being:

(a) providing a means to confine said bed of catalyst; maintaining said catalyst submerged in said gas oil; and (b) rotatably moving said confining means thereby rotating said bed of catalyst in said system in order to continuously remove said formed hydrocarbon gases from contact with said catalyst bed.

28. The process according to claim 27, wherein said gas oil is a liquid hydrocarbon fraction boiling in the range of 650° to 1300° F. and having a pour point of above about 85° F.

29. The process according to claim 27, wherein said catalyst is zeolite ZSM-5.

30. The process according to claim 27, wherein said bed of catalyst is rotated at a speed of about 150 rpm.

* * * * *